United States Patent [19]

Ullum

[11] Patent Number: 4,727,658

[45] Date of Patent: Mar. 1, 1988

[54] DRYING MACHINE

[75] Inventor: Henrik Ullum, Karlslunde, Denmark

[73] Assignee: A/S Atlas, Ballerup, Denmark

[21] Appl. No.: 33,055

[22] Filed: Apr. 1, 1987

[30] Foreign Application Priority Data

Apr. 3, 1986 [DK] Denmark ..... 1530/86

[51] Int. Cl.[4] ..... F26B 17/20

[52] U.S. Cl. ..... 34/183; 34/182; 366/317

[58] Field of Search ..... 34/181, 182, 183, 39; 366/279, 317

[56] References Cited

U.S. PATENT DOCUMENTS

| | | | |
|---|---|---|---|
| 567,509 | 9/1896 | Reitz | 34/182 |
| 2,531,578 | 11/1950 | McIlvaine | 34/182 |
| 3,777,810 | 12/1973 | Phillips | 34/183 |

FOREIGN PATENT DOCUMENTS

| | | |
|---|---|---|
| 125494 | 2/1973 | Denmark . |
| 138406 | 8/1978 | Denmark . |
| 323462 | 7/1920 | Fed. Rep. of Germany . |
| 130800 | 2/1951 | Sweden . |

*Primary Examiner*—Larry I. Schwartz

*Attorney, Agent, or Firm*—Merchant, Gould, Smith, Edell, Welter & Schmidt

[57] ABSTRACT

A drying machine for the heating and drying of wet, comminuted materials comprises a stationary housing with a rotary, hollow rotor (1) with the admission and conducting away of a heating medium, and where the rotor has a number of annular drying elements (2) with heating channels (3), and comprises a number of lifting elements (4) secured by welding along the circumference of the drying elements. The lifting elements are plate items which extend over at least two consecutive drying elements, and consist of a lifting part (8) and a deflection part (7).

4 Claims, 4 Drawing Figures

DRYING MACHINE

Figure 1:
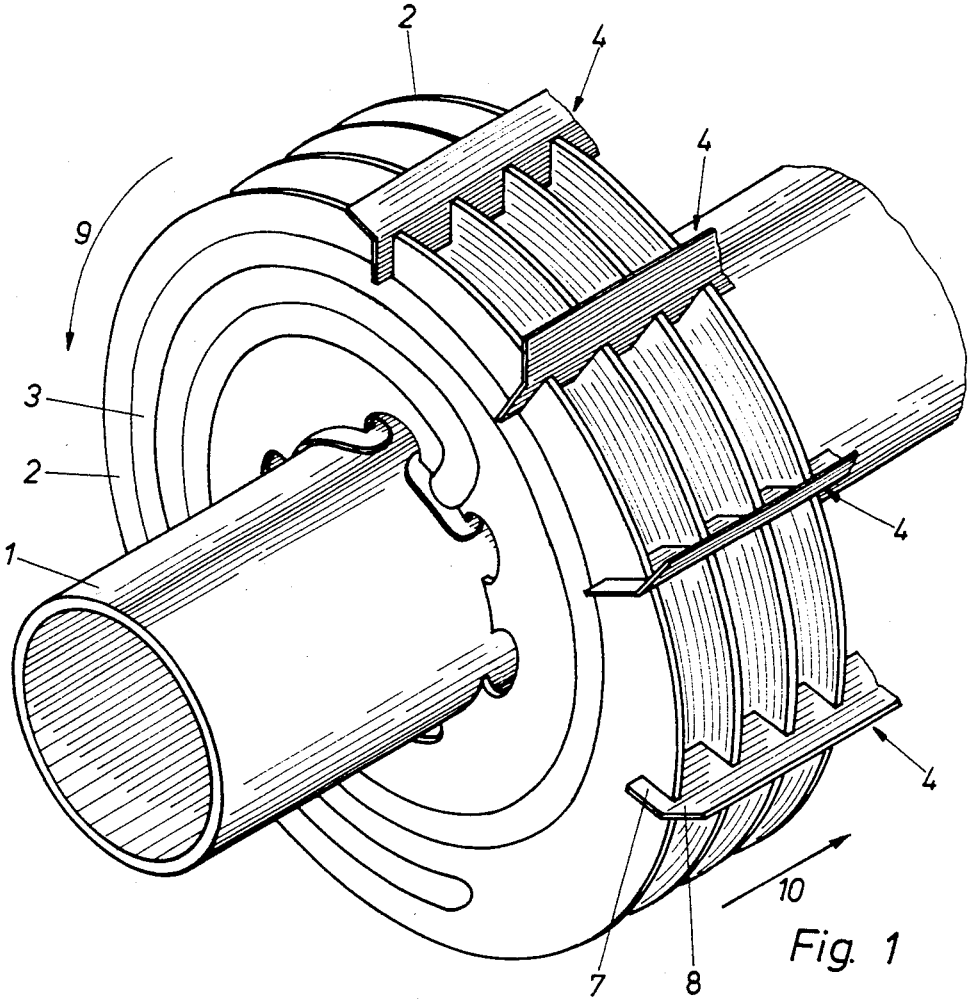

The invention relates to a drying machine.

Such drying machines are known, for example, from Danish Pat. No. 138,406, where the machine's rotor is provided with channels in the annular drying elements, which on the surface have completely smooth areas in contact with the material being dried, so that it is difficult for the material to stick to such areas and thus reduce the efficiency of the machine. Extending in between the drying elements, stationary clearing blades can be disposed, particularly in that zone in which the material being dried is still very moist and adhesive. Moreover, on the rotating drying elements themselves, transverse or oblique vanes can be disposed, and these help to move the material being dried forward towards a discharge opening for the dried product.

From Danish document No. 125,494, a drying machine of the kind in question is known with vanes arranged on the outer edge of the drying elements. The object of these vanes is to increase the stirring in the material which is to be dried, for which purpose the vanes are comprised of plane parts which push the material. If the vanes are arranged obliquely in relation to the direction of rotation, they also contribute towards the forward transport in the drying machine. For reasons of the great friction, this method of drying demands a high consumption of energy, in that the vanes have to be pressed through the material, during which there can occur an adverse loading of the drying elements, for example uneven loading.

Machines of this kind are used, for example, for the drying of fishmeal, comminuted offal, mash and similar products, and are usually designed for very large capacities, for example the drying of 1–4 tons per hour.

The object of the invention is to improve a machine of this kind, so that an improved drying and mixing during the drying process is achieved, whereby the efficiency of the drying machine is increased.

This is achieved by constructing the machine according to the invention as presented in more detail and as characterized in claim 1. The lifting elements lift the material being dried in portions, and in doing so, they tear possible clumps into pieces. The lifted material falls down over the drying rotor, and is thus exposed to more frequent contact with the heating surfaces. At the same time, a better stirring is herewith achieved, so that the material being dried is mixed more thoroughly than otherwise, the result being that the end product is completely uniform. The special positioning of the lifting elements according to the invention ensure a solid securing of same to more drying elements, thus making possible the use of relatively large lifting elements so that a very effective tumbling of the material being dried is achieved.

By constructing the drying machine according to the invention as presented, one can distribute the securing over the whole of the lifting element, the result being a very rigid construction. Moreover, the force applied on the lifting element by the material being dried is distributed among more drying elements, and possibly to both sides hereof, so that the load is distributed over all of the securing means, for example all the welding seams.

This provides the possibility of individual dimensioning of the lifting part and the deflecting part, so that they can each be given optimum dimensions with regard to both strength and function, for example as presented in more detail and as characterized in claim 4. One can hereby dimension the lifting element according to the invention so that the material being dried is lifted relatively high and is greatly spread during its fall down over the rotor and between the drying elements, the result being that it makes the best possible contact with the heating surfaces, and at the same time is herewith vigorously mixed.

The drying element according to the invention can be constructed, whereby a solid, hard-wearing construction without protruding securing elements is achieved.

By constructing the drying element according to the invention, one can determine how quickly the material to be dried is to move forward in the machine and, if so desired, one can arrange the drying elements in such a way that the material being dried remains in one zone for a longer time than in another zone. Depending on the degree and direction of the slope in relation to the axis of rotation, one can control the movement patterns of the forwards-moving material being dried. One is hereby provided with the further possibility of being able to adjust the drying machine in precise accordance with the raw materials which are to be dried. The consumption of energy is hereby optimized, so that the drying machine according to the invention uses the least possible thermal energy for the process, without this having any adverse effect on the production speed and the quality.

Figure 2:
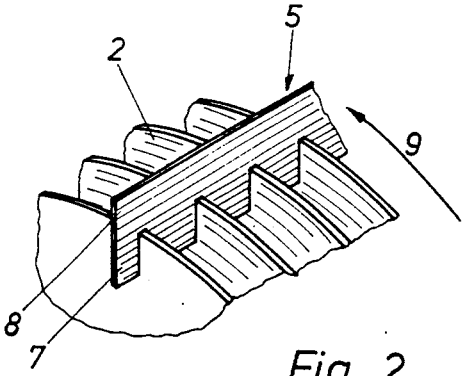
Figure 3:
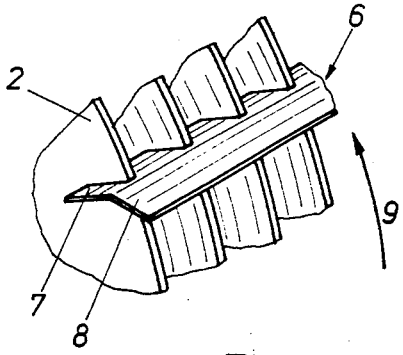
Figure 4:
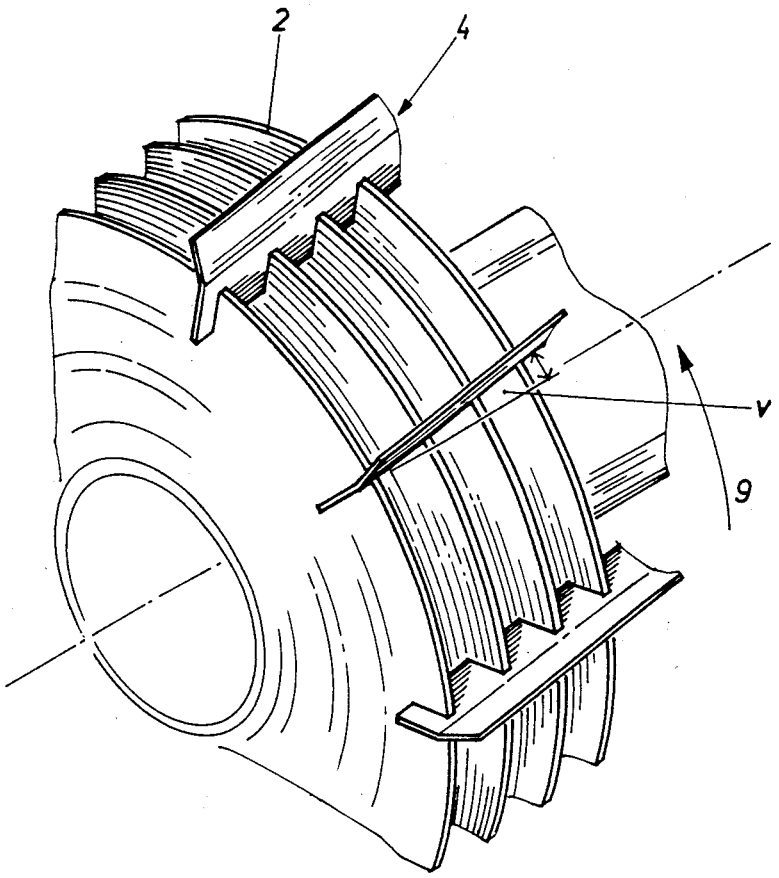

The invention will now be described in more detail with reference to the drawing, which shows an embodiment of the drying machine according to the invention, and where FIG. 1 shows a perspective drawing of a part of a rotor with drying elements and a number of lifting elements, FIG. 2 shows a lifting element according to a second embodiment, FIG. 3 shows a lifting element according to a third embodiment, and FIG. 4 shows the same as FIG. 1, but with lifting elements arranged at a certain angle to the rotor axis.

In FIG. 1 of the drawing, a part of a hollow rotor axle 1 is shown with a number of annular elements 2 in which there are extending, for example, helical heat channels 3, said channels being connected to a heat source, for example a steam generator, through pipes in the hollow axle 1. The channels 3 in the annular heating elements 2 can also be heated by hot water, hot oil or similar heating mediums. The axle 1 with a number of drying elements 2 rotates as shown by the arrow 9. Around the rotor is arranged a stationary housing, not shown, with a filling opening, discharge opening and possibly a heat jacket and inspection port, cleaning port etc.

In FIG. 1, the arrow 10 shows the normal direction of transport through the drying machine from a filling opening to a discharge opening. On the drying elements 2, there are secured a number of lifting elements 4 consisting of a lifting part 8 and a deflection part 7, in that the deflection part 7 is provided with recesses corresponding to the thickness of the drying elements 2, so that the lifting element 4 is in the form of a plate with cam-like shape and broad teeth, corresponding to the distance between the drying elements 2.

The lifting element can be bent as shown in FIG. 1, so that the lifting part 8 forms an angle of less than 180° to the deflection part 7. The securing is effected by welds along the recesses in the deflection part 7.

In FIG. 2 is shown a lifting element 5 which is completely plane in shape, and in FIG. 3 is shown a lifting element 6 which is bent the opposite way in relation to the direction of rotation 9, when compared with the lifting element 4 in FIG. 1. The shape of the lifting element is adapted to the material which is to be processed in the drying machine.

The lifting elements can be arranged as shown in FIG. 4, so that the oblong lifting elements are still positioned in an essentially radial manner, but form an angle of between 0° and 15° in relation to the rotor's axle 1. The lifting elements thus contribute towards the transport of the material through the drying machine, or have a braking effect on said material. The lifting elements shown in FIG. 4 seek to transport the material in a direction opposite to the normal throughput direction 10 in FIG. 1. However, if one continues to add material to be dried through the filling opening the arrangement of the lifting elements as shown in FIG. 4 will only be able to brake the transport, so that the material being dried will remain for a longer time in that zone in which the lifting elements are arranged as shown in FIG. 4. One can thus ensure that the material being dried remains for a longer period in one zone than in another zone in the drying machine.

Drying machines of the kind dealt with here rotate at about 5–20 revolutions per minute. Depending on the product to be dried, one provides lifting elements in those zones in which one wishes to achieve the desired effect. The lifting elements 4, 5, 6 according to the invention are usually made of stainless steel, as is the case with the rotor and the drying elements. The lifting elements can extend over and be secured to a number of drying elements, depending on the size of the drying machine. In large drying machines, the lifting elements can be several meters in length and thus extend over 2–20 drying elements and possibly even more.

What is claimed is:

1. Drying machine for the heating and drying of wet, comminuted materials, said machine comprising: a stationary housing with a rotary, hollow axle for admission and extraction of heat and condensate thereof, and wherein the rotor has a plurality of annular drying elements arranged at intervals, and which are heated, including lifting elements arranged along the periphery of said drying elements, and wherein the lifting elements include plates which are secured to and span at least two adjacent drying elements and wherein said plates include slots to radially engage said drying elements and wherein said portion of each plate includes a lifting portion extending generally from a radially outermost edge of said plate and a deflecting portion extending generally beyond the surface of and perpendicular to said drying elements.

2. Drying machine according to claim 1, wherein the lifting portion and the deflection portion are in intersecting planes.

3. Drying machine according to claim 1 wherein the lifting element is made of stainless steel and is permanently secured to the drying elements by welding.

4. Drying machine according to claim 1 wherein the lifting elements are arranged in an essentially radial manner in relation to the drying elements and at an angle between 0° and 15° in relation to the axis of the rotor.

* * * * *